US006522070B1

(12) United States Patent
Nakazawa et al.

(10) Patent No.: US 6,522,070 B1
(45) Date of Patent: Feb. 18, 2003

(54) PLASMA DISPLAY PANEL PROVIDED WITH A DISCHARGE ELECTRIC INCREASING MEMBER AND/OR A DISCHARGE ELECTRIC FIELD CONTROLLER

(75) Inventors: Akira Nakazawa, Kawasaki (JP); Nobuhiro Iwase, Kawasaki (JP); Hitoshi Yamada, Kawasaki (JP); Noriyuki Awaji, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/563,884

(22) Filed: May 3, 2000

(30) Foreign Application Priority Data

Jun. 29, 1999 (JP) ..... 11-183719

(51) Int. Cl.[7] ..... H01J 17/49
(52) U.S. Cl. ..... 313/582; 313/586; 313/587
(58) Field of Search ..... 313/582, 586, 313/585, 587, 483, 484, 485

(56) References Cited

U.S. PATENT DOCUMENTS 4,320,418 A * 3/1982 Pavliscak ..... 313/587
4,322,656 A * 3/1982 Huber et al. ..... 313/485
5,661,500 A * 8/1997 Shinoda et al. ..... 313/585
6,339,292 B1 * 1/2002 Ha ..... 313/582

* cited by examiner

*Primary Examiner*—Vip Patel
*Assistant Examiner*—Joseph Williams
(74) *Attorney, Agent, or Firm*—Staas & Halsey LLP

(57) ABSTRACT

A plasma display panel comprising a pair of substrates defining a discharge space, a plurality of display electrodes for surface discharge between adjacent electrodes formed on one of the substrates, an insulator layer formed thereon, a plurality of address electrodes crossing the display electrodes formed on the other substrate and belt-shaped barrier ribs formed between the address electrodes, wherein a discharge electric field controller is formed under the insulator layer and a discharge electric field increasing member is formed in an elongated discharge space formed between adjacent barrier ribs along the direction of the address electrodes.

14 Claims, 11 Drawing Sheets

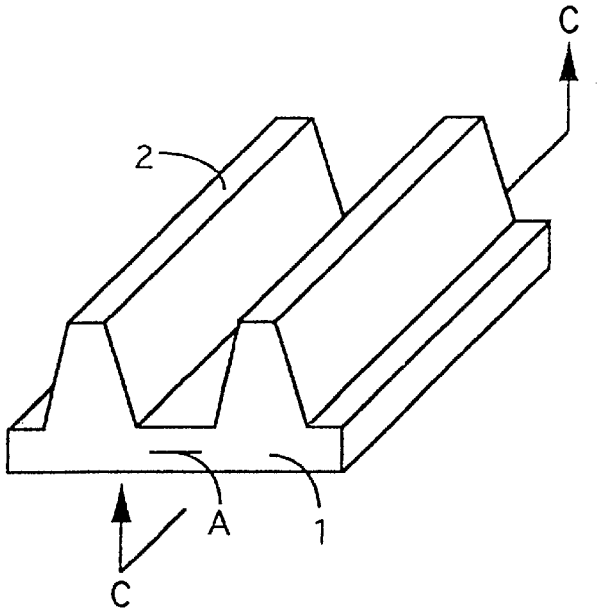
Fig.2(a)
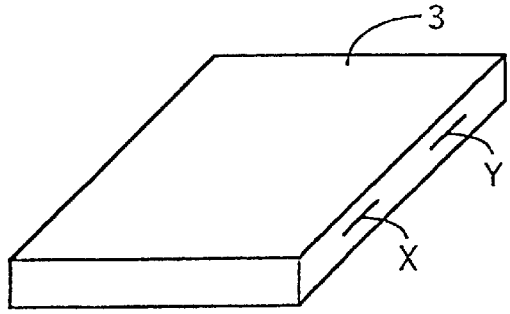
Fig.2(b)
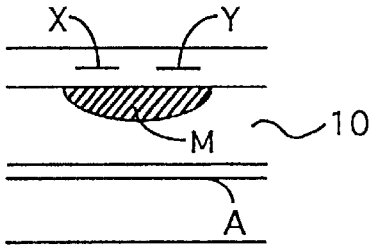
Fig.2(c-1)
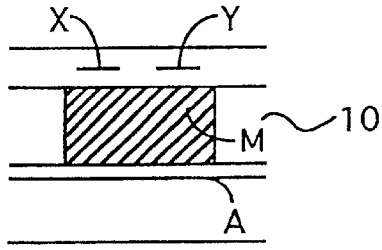
Fig.2(c-2)
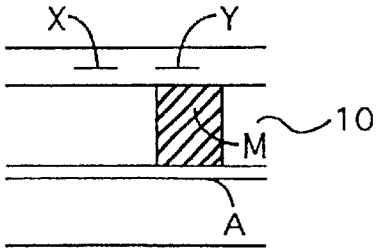
Fig.2(c-3)
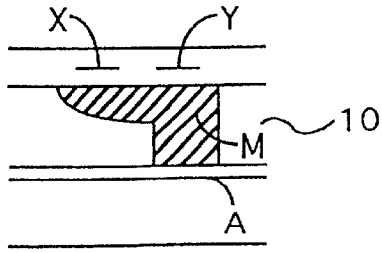
Fig.2(c-4)

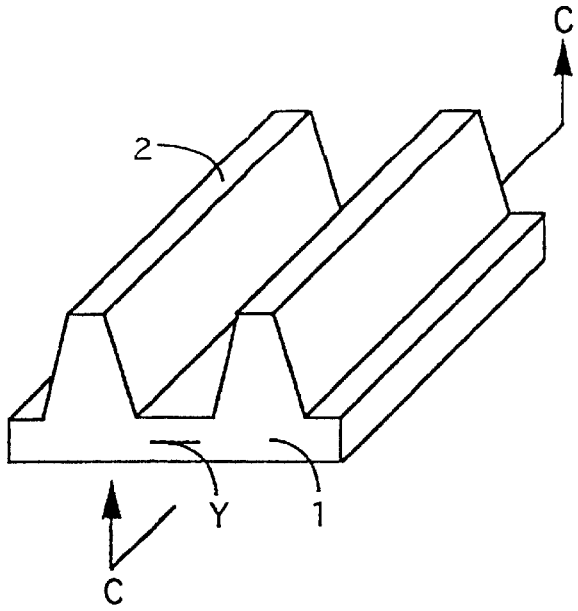
Fig.3(a)
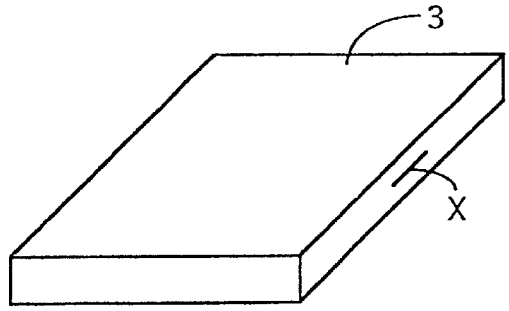
Fig.3(b)
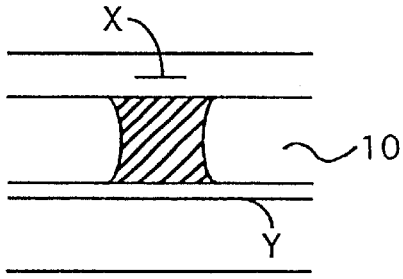
Fig.3(c-1)
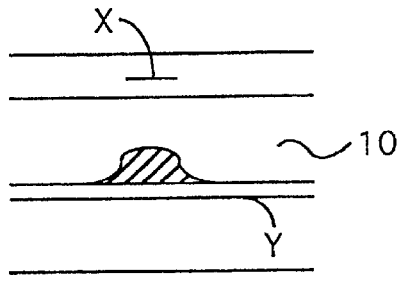
Fig.3(c-2)
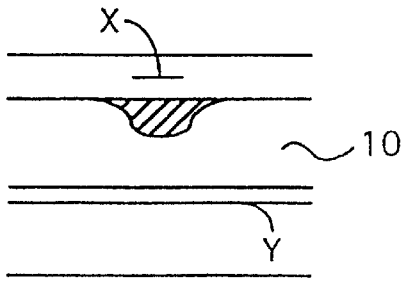
Fig.3(c-3)

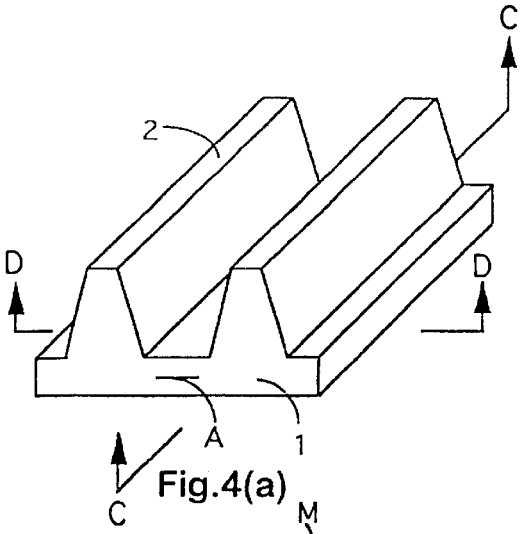
Fig.4(a)
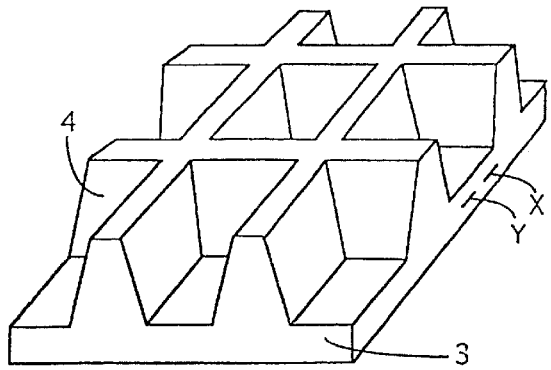
Fig.4(b)
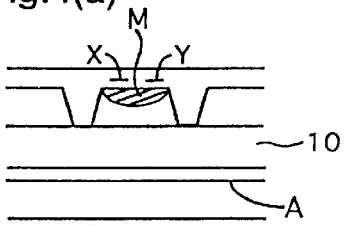
Fig.4(c-1)
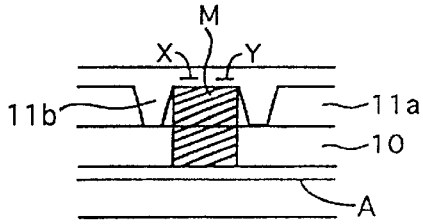
Fig.4(c-2)
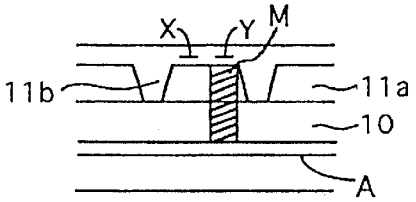
Fig.4(c-3)
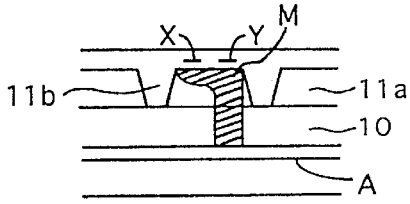
Fig.4(c-4)
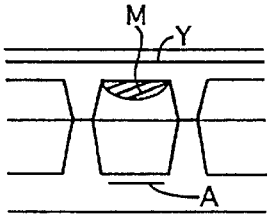
Fig.4 (d-1)
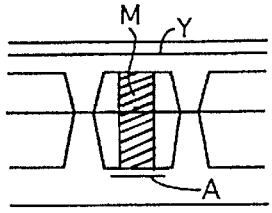
Fig.4(d-2)
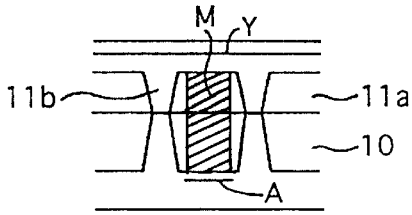
Fig.4(d-3)
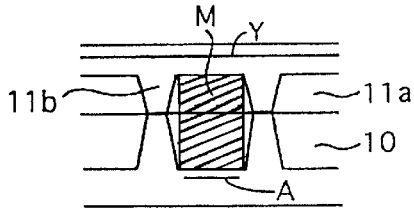
Fig.4(d-4)

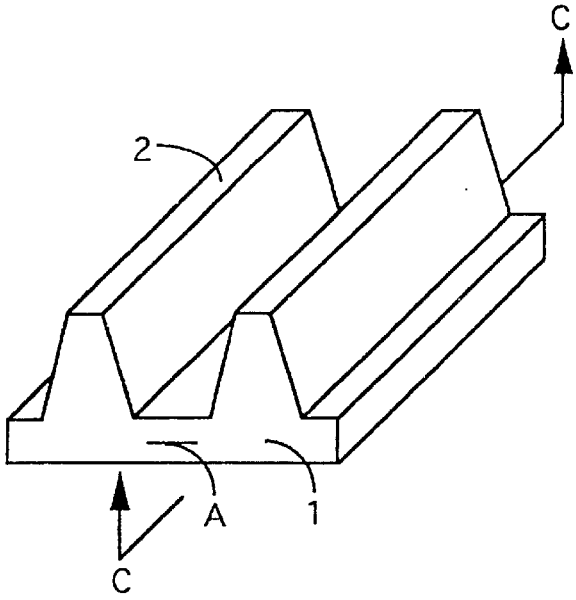
Fig.6(a)
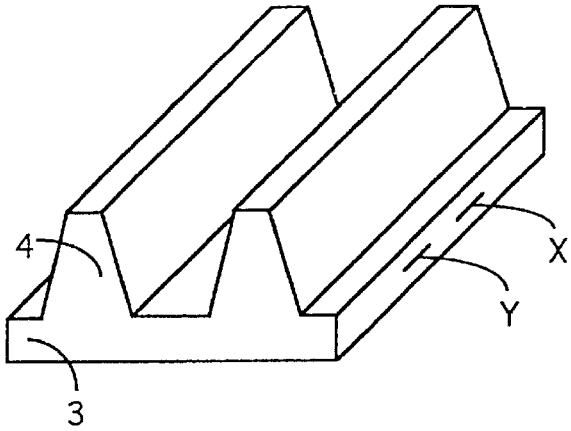
Fig.6(b)
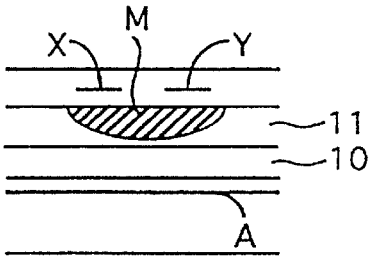
Fig.6(c-1)
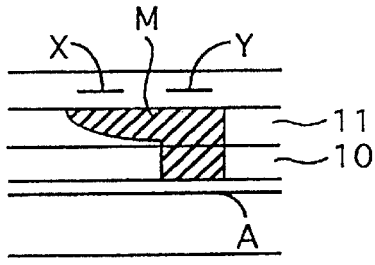
Fig.6(c-2)
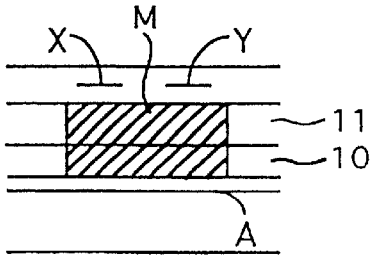
Fig.6(c-3)

PLASMA DISPLAY PANEL PROVIDED WITH A DISCHARGE ELECTRIC INCREASING MEMBER AND/OR A DISCHARGE ELECTRIC FIELD CONTROLLER

CROSS-REFERENCE TO RELATED APPLICATION

This application is related to Japanese application No. HEI 11 (1999)-183719 filed on Jun. 29, 1999, whose priority is claimed under 35 USC §119, the disclosure of which is incorporated by reference in its entirety.

BACKGROUND OF THE INVENTION

1. Field of the Invention

The present invention relates to a plasma display panel (hereinafter referred to as PDP).

2. Description of Related Art

PDP is a thin-type display device excellent in visuality, capable of high-speed displaying, and also capable of easily forming a relatively large screen. Particularly, an AC-type and a surface discharge type PDP is a PDP wherein display electrodes which become a pair at the application of a driving voltage are arranged on a same substrate, and is suitable for a color display by a phosphor.

Now, in an AC-type PDP of prior art, a protective layer made of magnesium oxide excellent in sputtering resistance is used to prevent the elements constituting PDP from being damaged by sputtering at electric discharge.

Also, in PDP, electric discharge begins at a portion having a narrow gap between electrodes and extends to wide gap portions. The electric discharge generates ultraviolet rays from a gas existing in a discharge space and the phosphor is excited by the ultraviolet rays to generate a visible light. As the gas existing in the discharge space, an inert gas containing Xe has been usually used.

Magnesium oxide used for the above-described protective layer has a feature that the discharging voltage is relatively low. However, to reduce power consumption of PDP, it has been desired to further lower the discharging voltage of the protective layer.

In regard to the gap between the electrodes, in the portion of the wide gap (the region of a long discharging length), the light-emission efficiency is good but the discharging voltage becomes high. On the other hand, in the portion of the narrow gap (the region of a short discharging length), the discharging voltage becomes low but the light emission efficiency is lowered. Accordingly, it has been desired to lower the discharging voltage while prolonging the discharging length.

Furthermore, in regard to the gas existing in the discharge space, when the partial pressure of Xe is increased, the light emission efficiency of ultraviolet rays is increased but the discharging voltage is increased. Also, when the partial pressure of Xe is lowered or the partial pressure of other easily discharging gas (Ne, etc.) is increased, the discharging voltage is lowered but the light emission efficiency is lowered. Accordingly, it has been desired to lower the discharging voltage while increasing the partial pressure of Xe.

SUMMARY OF THE INVENTION

Thus, according to a first aspect of the invention, there is provided a plasma display panel (PDP) equipped with a plurality of main electrodes for display, characterized in that a discharge electric field increasing member (discharge electric field enhancer)is provided in at least a part of elements constituting the plasma display panel existing between main electrodes which generate discharge.

Furthermore, according to a second aspect of the invention, there is provided a plasma display panel (PDP) having a pair of substrates defining a discharge space between them, a plurality of display electrodes for surface discharge between adjacent electrodes on one of the substrates and an insulator layer covering the display electrodes, characterized in that a discharge electric field controller is formed under the insulator layer.

Also, according to a third aspect of the invention, there is provided a plasma display panel (PDP) having a pair of substrates defining a discharge space between them, a plurality of display electrodes for surface discharge between adjacent electrodes on one of the substrates, an insulator layer formed on the discharge electrodes, a plurality of address electrodes crossing the display electrodes formed on the other substrate and belt-shaped barrier ribs disposed between the address electrodes, characterized in that a discharge electric field controller is formed under the insulator layer and a discharge electric field increasing member is formed in an elongated discharge space formed between adjacent barrier ribs along the direction of the address electrodes.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 2(*a*)–2(*b*) are schematic views illustrating a construction of a PDP according to the present invention where FIGS. 2(*a*) and 2(*b*) show back and front substrates, respectively;

FIGS. 2(*c*-1 )–2(*c*-4) are cross sectional views of the PDP according to the present invention cut along the line C—C of FIG. 2(*a*) showing respective positions of a discharge electric field increasing member;

FIGS. 3(*a*)–3(*b*) are schematic views illustrating the construction of the PDP according to the present invention where FIGS. 3(*a*) and 3(*b*) show back and front substrates, respectively;

FIGS. 3(*c*-1 )–3(*c*-3) are cross sectional views of the PDP according to the present invention cut along the line C—C of FIG. 3(*a*) showing respective positions of the discharge electric field increasing member;

FIGS. 4(*a*)–4(*b*) are schematic views illustrating the construction of the PDP according to the present invention where FIGS. 4(*a*) and 4(*b*) show back and front substrates, respectively;

FIGS. 4(*c*-1 )–4(*c*-4) are cross sectional views of the PDP according to the present invention cut along the line C—C of FIG. 4(*a*) showing respective positions of the discharge electric field increasing member;

FIGS. 4(*d*-1 )–4(*d*-4) are cross sectional views of the PDP according to the present invention cut along the line D—D of FIG. 4(*a*) showing respective positions of the discharge electric field increasing member;

FIGS. 5(*c*)–(*d*) are cross sectional views of the PDP according to the present invention along the lines C—C and D—D of FIG. 5(*a*), respectively, showing respective positions of the discharge electric field increasing member;

FIGS. 6(*a*)–6(*b*) are schematic views illustrating the construction of the PDP according to the present invention where FIGS. 6(*a*) and 6(*b*) show back and front substrates, respectively;

FIGS. 6(*c*-1 )–6(*c*-3) are cross sectional views of the PDP according to the present invention cut along the line C—C of FIG. 6(*a*) showing respective positions of the discharge electric field increasing member;

FIG. 8(*c*) is a cross sectional view of the PDP according to the present invention cut along the line C—C of FIG. 8(*a*) showing a position of the discharge electric field increasing member;

FIG. 8(*d*) is a schematic view showing another front substrate, which can be used in place of the front substrate of FIG. 8(*b*);

FIGS. 9(*c*)–9(*d*) are cross sectional views of the PDP according to the present invention cut along the lines C—C and D—D of FIG. 9(*a*), respectively, showing respective positions of the discharge electric field increasing member;

FIG. 9(*d*) is a schematic view showing another front substrate, which can be used in place of the front substrate of FIG. 9(*b*);

FIG. 10(*d*) is a top view of the construction of the PDP as shown in FIGS. 10(*a*)–10(*c*);

DESCRIPTION OF THE PREFERRED EMBODIMENTS

Then, the present invention is described in detail.

In PDP of the first aspect of the invention described above, a discharge electric field increasing member is formed in at least a part of the elements constituting PDP, existing between a pair of electrodes. The PDP of the first aspect can be applied to an AC-type (surface discharge type or counter discharging type) PDP and a DC type PDP. Among these, the PDP of the first aspect of the invention is preferably applied to the AC type PDP.

In this invention, the discharge electric field increasing member means a constituent element for further strengthening the discharging electric field generated in the discharge space of PDP. By forming the discharge electric field increasing member, the discharging initiation voltage can be lowered without almost lowering the discharging electric current. Accordingly, a gap between the electrodes performing electric discharge can be widened or the partial pressure of Xe in a discharging gas can be increased. As a result thereof, the discharging efficiency can be improved and also it becomes possible to lower the voltage of the driving circuit.

It is preferred that the discharge electric field increasing member is made of a material having an electric conductivity of a higher impedance than the impedance of a discharged portion by discharging between a pair of electrodes. Practically, examples of the material include a metal such as chromium, tungsten, molybdenum, etc.; a metal oxide such as tin oxide, indium oxide, zinc oxide, etc.; and carbon. These materials may be used singly or as a mixture thereof. Furthermore, the materials may be used as a mixed crystal thereof or may be used as a mixture or together with a dielectric material (including a phosphor). In addition, it is preferred that the discharge electric field increasing member has a resistance of from about 10 to $10^{10}$ Ω·cm. However, when the resistance of the discharge electric field increasing member is low, it is preferred that the discharge electric field increasing member is covered with a phosphor layer or a dielectric layer.

As to the disposed place of the discharge electric field increasing member, the discharge electric field increasing member is formed on the surface of the element constituting PDP near the pair of electrodes to be discharged or added into the element. Furthermore, the discharge electric field increasing member may be formed on the surface of the element constituting PDP or added into the element over the whole body. However, the discharge electric field increasing member may be formed on or added into only a necessary portion as long as it is possible to increase the discharging electric field. Practical examples of the disposed positions of the discharge electric field increasing member are explained using the 3-electrode AC-type surface discharge PDP shown in FIG. 1.

Figure 1:
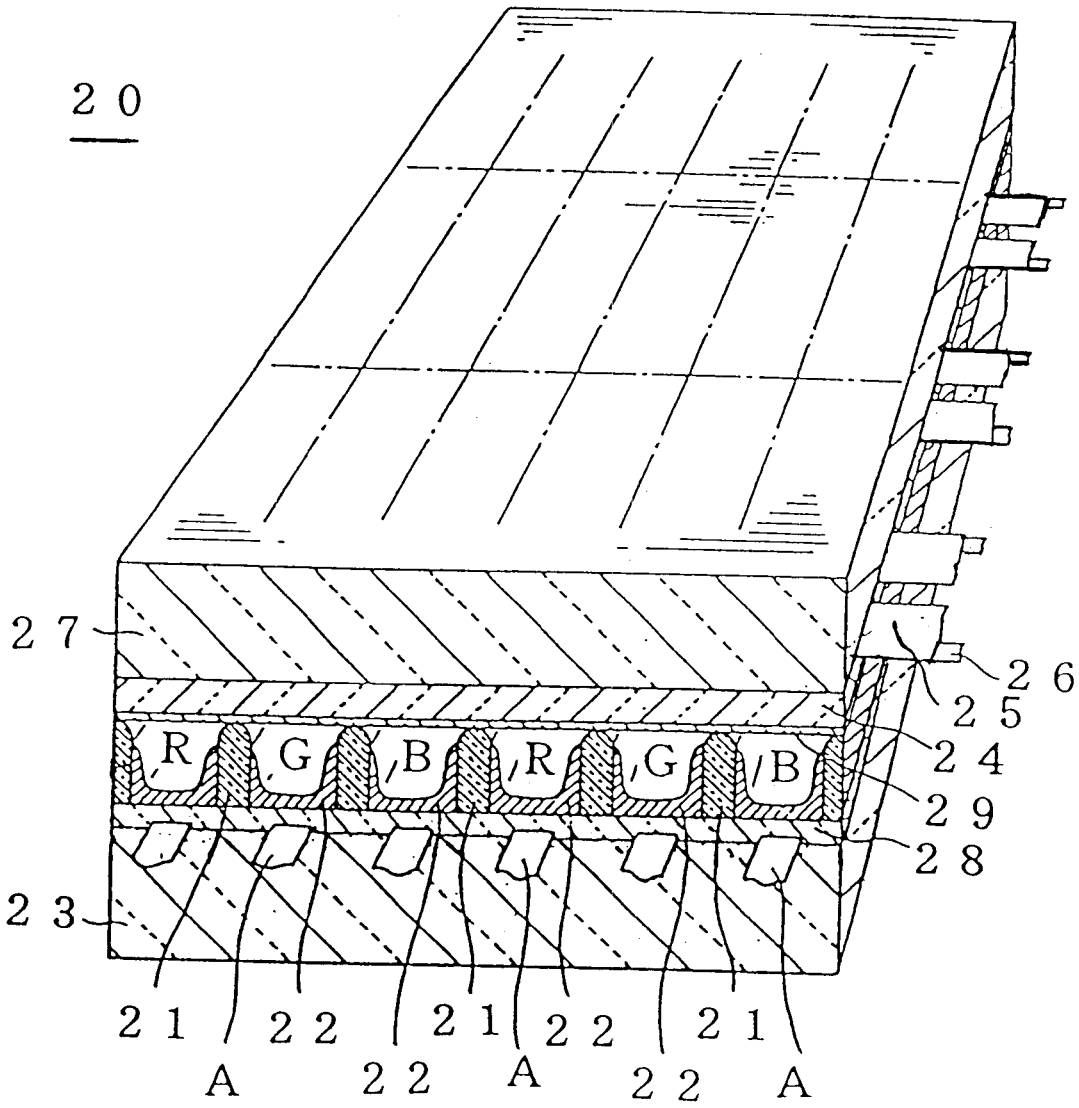
FIG. 1 is a schematic view illustrating a construction of a PDP.
Figure 5B:
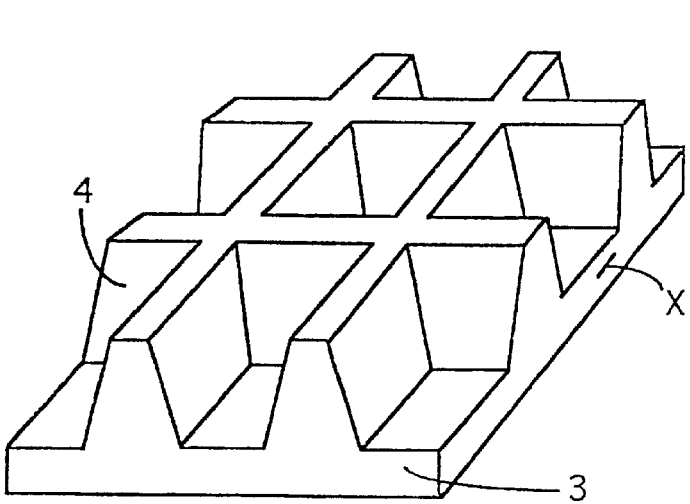
FIGS. 5(*a*)–5(*b*) are schematic views illustrating the construction of the PDP according to the present invention where FIGS. 5(*a*) and 5(*b*) show back and front substrates, respectively.
Figure 5A:
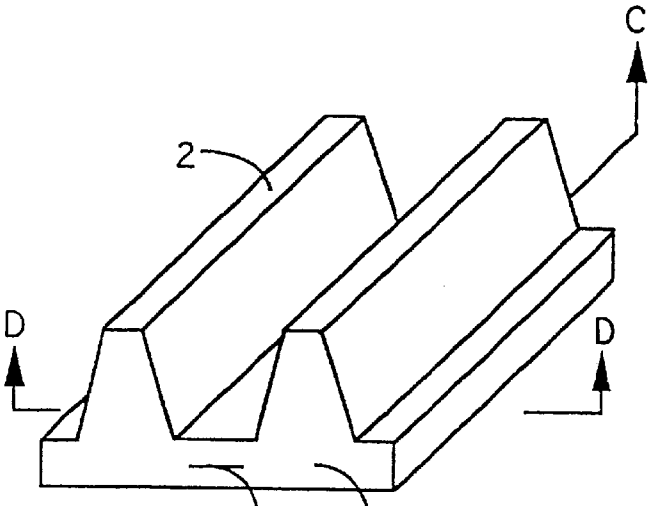
Figure 5D:
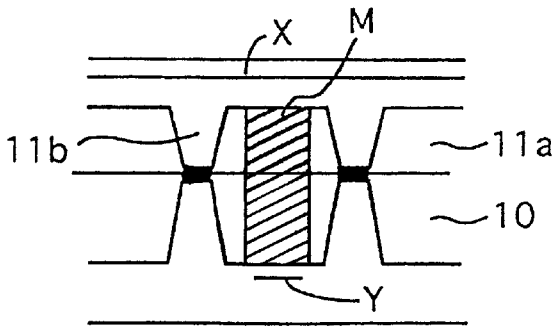
Figure 5C:
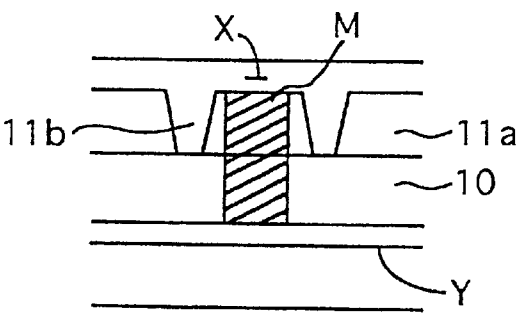

The PDP 20 of FIG. 1 is composed of a back substrate and a front substrate. The back substrate comprises address electrodes A formed on a substrate 23, a dielectric layer 28 formed as covering the address electrodes A, belt-shaped barrier ribs 21 each formed on the dielectric layer 28 between the address electrodes A, and phosphor layers 22 formed between the barrier ribs 21 and on the sidewalls of the barrier ribs 21. The front substrate comprises a substrate 27, display electrodes (in FIG. 1, laminates each composed of a transparent electrode 25 and a bus electrode 26) for surface discharge, which are principal electrodes, formed on the substrate 27, a dielectric layer 24 formed as covering the display electrodes, and a protective layer 29 formed on the dielectric layer 24. The back substrate and the front substrate face each other via the barrier ribs 21 so that the display electrodes and the address electrodes A are arranged as crossing with each other, and a discharging gas is sealed in an elongated space (discharge space) divided by the barrier ribs 21. Thus, the PDP is formed.

In the case of the above-described PDP shown in FIG. 1, the discharge electric field increasing member M, as shown in, for example, FIG. 2(*c*-1), can be formed on the surface of the barrier ribs 21 or added into the barrier ribs 21, in the phosphor layer 22, on the dielectric layer 28 of the back substrate, or between the protective layer 29 and the dielectric layer 24 of the front substrate. Also, the discharge electric field increasing member M may be used as the dielectric layer 24 of the front substrate or the protective layer 29 itself of the front substrate. Furthermore, in the case where the structure is such that the protective layer 29 of the front substrate has the function of the dielectric layer 24 and the protective layer together, the discharge electric field increasing member M can be formed between the display electrodes and the protective layer 29. The discharge electric field increasing member M may be formed in one position or plural positions. Incidentally, the discharge electric field increasing member M is disposed in the same manner as the above in the case of a so-called two-electrodes facing discharging type PDP wherein main electrodes constituting a pair are separately disposed on the front substrate and the back substrate in a crossed state at a right angle.

Then, the constituent elements of the above-described PDP are explained.

There is no particular restriction on the materials of the substrates 23 and 27, and a glass substrate, a quartz glass substrate, a silicon substrate, etc. may be used. The transparent electrode 25 is made of a transparent conductive film such as ITO. The bus electrodes 26 and the address electrodes A are made of a metal layer of Al, Cr, Cu, etc., a 3-layer structure of Cr/Cu/Cr, etc. The dielectric layers 24 and 28 are formed by a material usually used for PDP. Practically, the dielectric layers 24 and 28 can be formed by applying a paste made of a low-melting glass and a binder on the substrates followed by calcining. The protective layer 29 is formed for protecting the dielectric layer 24 from being damaged by the impact of ions generated by electric discharge for display, and is made of MgO, CaO, SrO, BaO, etc.

The belt-shaped barrier ribs 21 are formed by applying a paste made of a low-melting glass and a binder on the dielectric layer 28 followed by calcining, and cutting by a sand blast method. Furthermore, when a photosensitive resin is used as the binder, the applied paste is exposed and developed using a predetermined mask and then calcined to form the belt-shaped barrier ribs 21. The phosphor layers 22 each can be formed in the groove between the barrier ribs 21 and on the sidewalls of the barrier ribs by applying a phosphor paste containing a phosphor and a binder throughout the elongated groove between the barrier ribs 21, drying the applied phosphor paste, and then calcining under an inert atmosphere.

It is preferred that the discharge electric field increasing member M is formed on the barrier ribs 21, added in the barrier ribs 21 or in the phosphor layers 22. Hereinafter, an example of positions for disposing the discharging electric field increasing member M in a PDP having barrier ribs 21 of a different shape will be explained. In the following figure, for the sake of simplifying the explanation, the electrodes, the barrier ribs 21 and the substrates 23 and 27 only are shown and other construction is omitted.

FIG. 2(*a*) shows a back substrate 1 equipped with an address electrode A and stripe-form barrier ribs 2 and FIG. 2(*b*) shows a front substrate 3 equipped with a pair of display electrodes X and Y. The back substrate 1 and the front substrate 3 are disposed facing each other via the barrier ribs 2 so that the address electrodes A and the display electrodes X and Y cross each other at a right angle to constitute the above-described three-electrode surface discharge type PDP as shown in FIG. 1. In this case, it is preferred that the discharge electric field increasing member M is disposed in the barrier ribs 2 or on the surfaces thereof. For example, when the discharge electric field increasing member M is formed at the portion shown by the shaded portion M of FIGS. 2(C-1) to 2(C-4), which are the cross-sectional views of PDP cut along the line C—C, one or both of the discharging electric field between the display electrodes X and Y and the discharging electric field between the address electrodes and the display electrodes X and Y can be increased. Also, the whole barrier ribs 2 may be the discharge electric field increasing member M. In addition, in FIGS. 2(C-1) to 2(C-4), the reference numeral 10 shows the barrier rib 2 of the back substrate side.

FIG. 3(*a*) shows a back substrate 1 equipped with a display electrode Y and stripe-form barrier ribs 2 and FIG. 3(*b*) shows a front substrate 3 equipped with a display electrode X. The back substrate 1 and the front substrate 3 face each other via the barrier ribs 2 so that the display electrodes X and Y cross each other at a right angle to construct the two-electrodes facing discharge type PDP. In this case, it is preferred that the discharge electric field increasing member M is disposed in the barrier ribs 2 or on the surfaces thereof. For example, when the discharge electric field increasing member M is formed at the portion shown by the shaded portion M of FIGS. 3(C-1) to 3(C-3) which are the cross-sectional views of the PDP cut along the line C—C, the discharging electric field between the discharge electrodes X and Y can be increased. Also, the whole barrier ribs may be the discharge electric field increasing member M. In addition, the reference numeral 10 in FIG. 3(C-1) to (C-3) shows the barrier rib at the back substrate side.

FIG. 4(*a*) shows a back substrate 1 equipped with an address electrode A and stripe-form barrier ribs 2 and FIG. 4(*b*) shows a front substrate 3 equipped with a pair of display electrodes X and Y and lattice-form barrier ribs 4. The back substrate 1 and the front substrate 3 face each other via the barrier ribs 2 and 4 so that the address electrodes and the display electrodes cross each other at a right angle to construct a three-electrode surface discharge type PDP. In this case, it is preferred that the discharge electric field increasing member M is disposed at least one portion of, in the barrier rib 2 of the back substrate 1, on the surface thereof, in the barrier rib 4 of the front substrate 3 or on the surface thereof. For example, when the discharge electric field increasing member M is formed at the portion shown by the shaded portion M of FIGS. 4(C-1) to 4(C-4) which are the cross-sectional views of the PDP cut along the line C—C and/or FIGS. 4(D-1) to 4(D-4) which are the cross-sectional views of the PDP cut along the line D—D, one or both of the discharging electric field between the display electrodes X and Y and the discharge electric field between the address electrode and the display electrodes X and Y can be increased. Also, the whole barrier ribs may be the discharge electric field increasing member M. In addition, in FIGS. 4(C-1) to 4(C-4) and FIGS. 4(D-1) to 4(D-4), the reference numeral 10 shows the barrier rib 2 at the back substrate side, 11*a* shows the barrier rib 4 of the front substrate side parallel to the sheet surface, and 11*b* shows the barrier rib 4 of the front substrate side perpendicular to the sheet surface.

FIG. 5(*a*) shows a back substrate 1 equipped with a display electrode Y and stripe-form barrier ribs 2 and FIG. 5(*b*) shows a front substrate 3 equipped with a display electrode X and lattice-form barrier ribs 4. The back substrate 1 and the front substrate 3 face each other via the barrier ribs 2 and 4 such that the display electrodes X and Y cross each other at a right angle to constitute a two-electrodes facing discharging type PDP. In this case, it is preferred that the discharge electric field increasing member M is disposed to at least one portion of, in the barrier ribs 2 of the back substrate 1, on the surfaces thereof, in the barrier ribs 4 parallel to the display electrode X of the front substrate 3, on the surface thereof, in the barrier ribs 4 perpendicular to the display electrode X of the front substrate 3 or on the surfaces thereof. For example, when the discharge electric field increasing member M is formed at the portions shown by the shaded portion M of FIG. 5(*c*) which is the cross-sectional view of the PDP of FIG. 5(*a*) cut along the line C—C and the shaded portion M of FIG. 5(*d*) which is the cross-sectional view of the PDP cut along the line D—D, the discharging electric field between the display electrodes X and Y can be increased. Also, the whole barrier ribs may be the discharge electric field increasing member M. In FIG. 5(*c*) and FIG. 5(*d*), the reference numeral 10 shows the barrier rib 2 of the back substrate side, 11*a* shows the barrier rib 4 of the front substrate side parallel to the sheet surface and 11*b* shows the barrier rib 4 of the front substrate side perpendicular to the sheet surface.

Figure 7A:
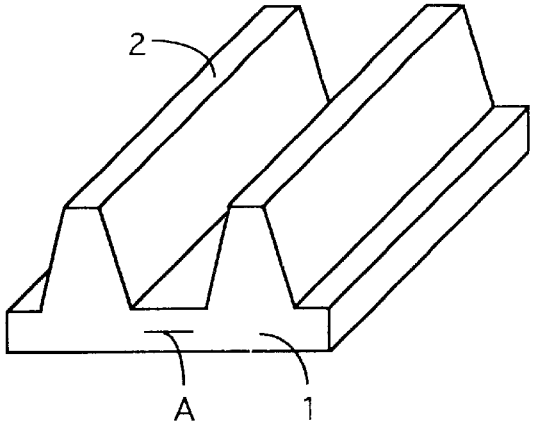
FIGS. 7(*a*)–7(*b*) are schematic views illustrating the construction of the PDP according to the present invention where FIGS. 7(*a*) and 7(*b*) show back and front substrates, respectively.
Figure 7B:
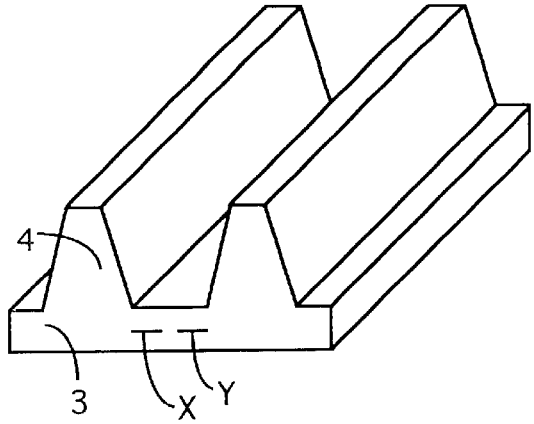
Figure 8A:
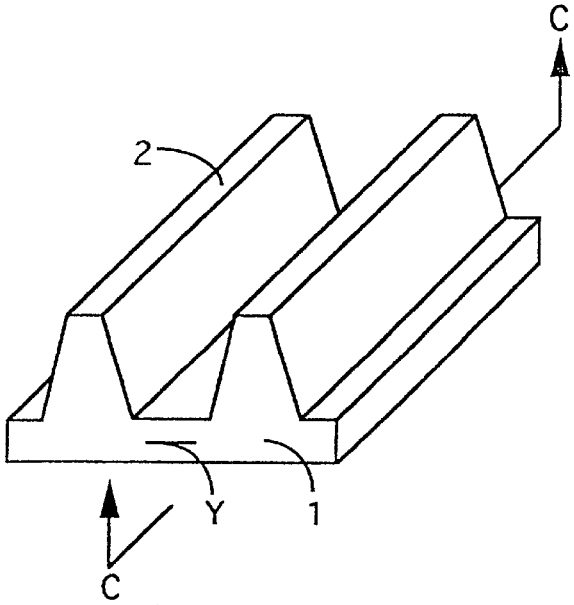
FIGS. 8(*a*)–8(*b*) are schematic views illustrating the construction of the PDP according to the present invention where FIGS. 8(*a*) and 8(*b*) show back and front substrates, respectively.
Figure 8B:
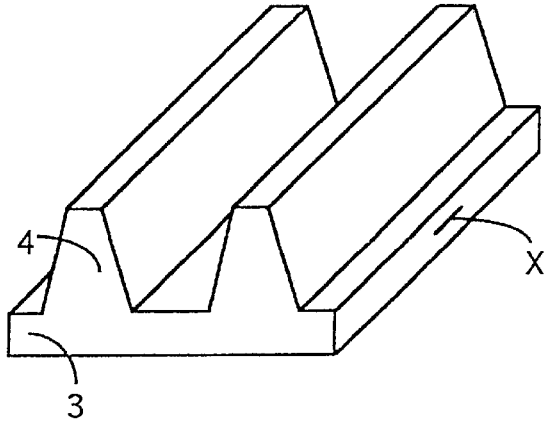
Figure 8C:
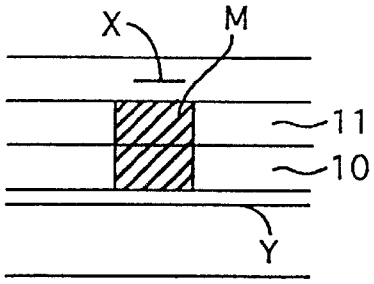
Figure 8D:
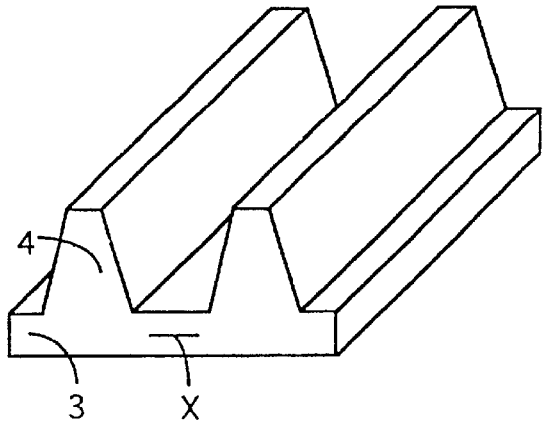
Figure 9A:
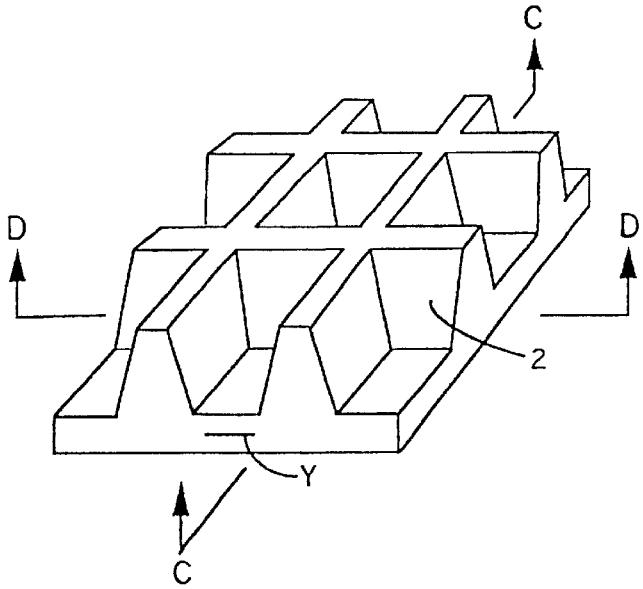
FIGS. 9(*a*)–9(*b*) are schematic views illustrating the construction of the PDP according to the present invention where FIGS. 9(*a*) and 9(*b*) show back and front substrates, respectively.
Figure 9B:
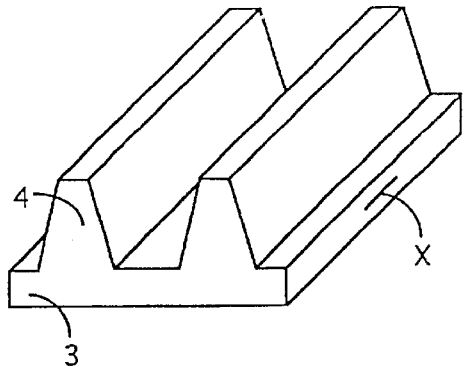
Figure 9C:
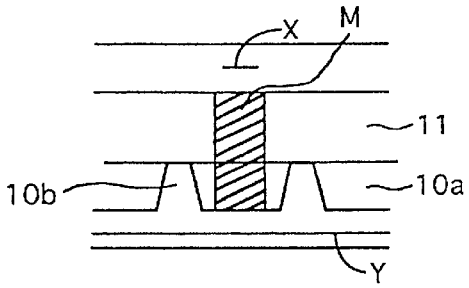
Figure 9D:
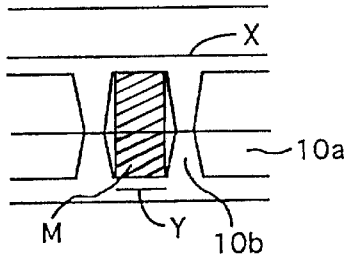
Figure 9E:
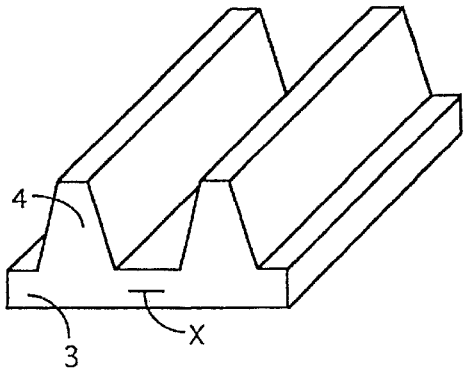
Figure 10A:
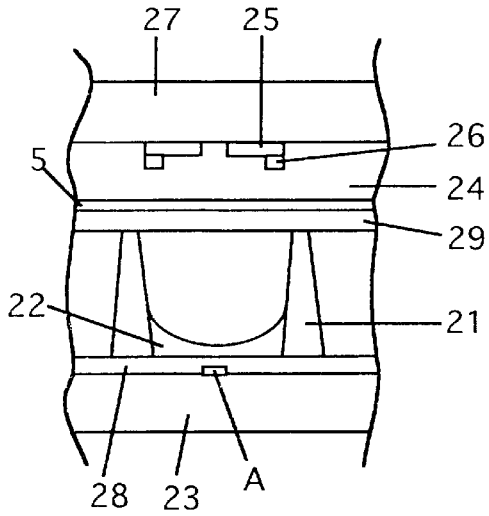
FIGS. 10(*a*)–10(*c*) are schematic views illustrating the construction of the PDP according to another embodiment of the present invention showing respective positions of the discharge electric field controlling material.
Figure 10B:
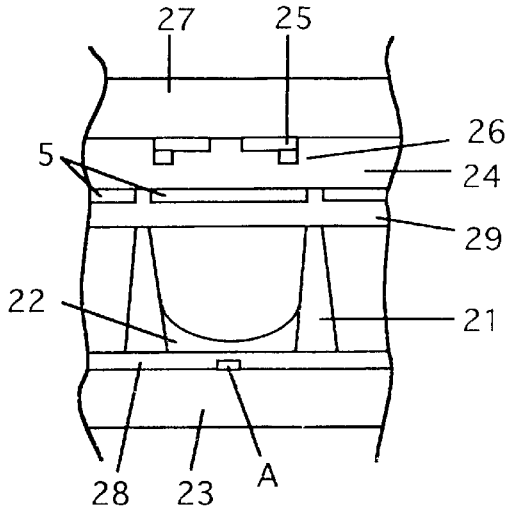
Figure 10C:
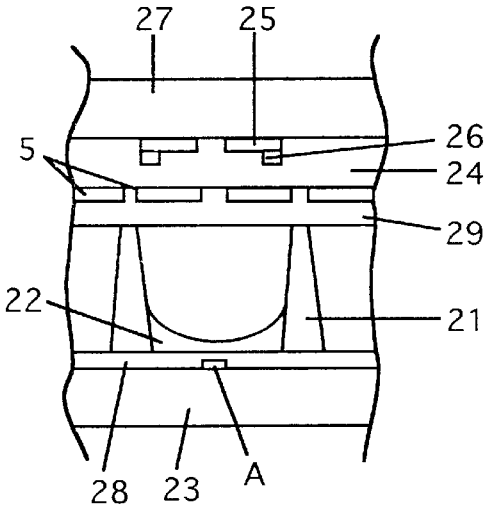
Figure 10D:
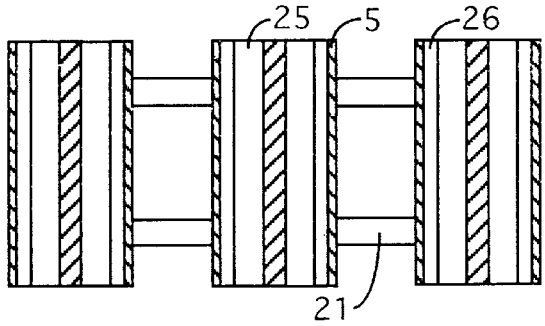

FIG. 6(*a*) shows a back substrate 1 equipped with an address electrode A and stripe-form barrier ribs 2 and FIG. 6(*b*) shows a front substrate 3 equipped with a pair of display electrodes X and Y and stripe-form barrier ribs 4. The back substrate 1 and the front substrate 3 face each other via the barrier ribs 2 and 4 such that the address electrodes A and display electrodes cross each other at a right angle to constitute a three-electrode surface discharge type PDP. In this case, it is preferred that the discharge electric field increasing member M is disposed to at least one portion of, in the barrier ribs 2 of the back substrate 1, on the surfaces thereof, in the barrier ribs 4 parallel to the display electrodes X and Y of the front substrate 3, on the surfaces thereof, in the barrier ribs 4 perpendicular to the display electrodes X and Y of the front substrate 3 or on the surfaces thereof. For example, when the discharge electric field increasing member M is formed at the portion shown by the shaded portion M of FIGS. 6(C-1) to 6(C-3), which are the cross-sectional views of the PDP of FIG. 6(*a*) cut along the line C—C, one or both of the discharging electric field between the display electrodes X and Y and the discharging electric field between the address electrodes A and the display electrodes X and Y can be increased. In this case, by the combination of a back substrate 1 of FIG. 7(*a*) and a front substrate 3 of FIG. 7(*b*), a surface discharge type PDP can be formed as the combination of the back substrate 1 of FIG. 6(*a*) and the front substrate 3 of FIG. 6(*b*) described above. Also, the whole barrier ribs may be the discharge electric field increasing member M. In addition, in FIGS. 6(C-1) to 6(C-3), the reference numeral 10 shows the barrier ribs 2 of the back substrate side and 11 shows the barrier ribs 4 of the front substrate side.

FIG. 8(*a*) is a back substrate 1 equipped with a display electrode Y and stripe-form barrier ribs 2 and FIG. 8(*b*) is a front substrate 3 equipped with display electrode X and stripe-form barrier ribs 4. The back substrate 1 and the front substrate 3 face each other via the barrier ribs 2 and 4 such that the display electrodes X and Y cross each other at a right angle to constitute a two-electrodes facing discharging type PDP. In this case, it is preferred that the discharge electric field increasing member M is disposed to at least one portion of, in the barrier ribs 2 of the back substrate 1, on the surfaces thereof, in the barrier ribs 4 parallel to the display electrodes of the front substrate 3, on the surfaces thereof, in the barrier ribs 4 perpendicular to the display electrodes of the front substrate 3 or on the surfaces thereof. For example, by forming the discharge electric field increasing member M at the portion shown by the shaded portions M of FIG. 8(*c*) which is the cross-sectional view of the PDP of FIG. 8(*a*) cut along the line C—C, the discharging electric field between the display electrodes X and Y can be increased. Also, by using the front substrate 3 of FIG. 8(*d*) in place of the front substrate of FIG. 8(*b*), a two-electrodes facing discharging type PDP can be formed. Furthermore, the whole barrier ribs may be the discharge electric field increasing member M. Also, the whole barrier ribs may be the discharge electric field increasing member M. In addition, in FIG. 8(*c*), the reference numeral 10 shows the barrier rib 2 of the back substrate side and 11 shows the barrier rib 4 of the front substrate side.

FIG. 9(*a*) is a back substrate 1 equipped with a display electrode Y and lattice-form barrier ribs 2 and FIG. 9(*b*) is a front substrate 3 equipped with a display electrode X and stripe-form barrier ribs 4. The back substrate 1 and the front substrate 3 face each other via the barrier ribs 2 and 4 such that the display electrodes X and Y cross each other at a right angle to constitute a two-electrodes facing discharging type PDP. In this case, it is preferred that the discharge electric field increasing member M is disposed to at least one portion of, in the barrier ribs 2 of the back substrate 1, on the surfaces thereof, in the barrier ribs 4 parallel to the display electrodes of the front substrate 3, on the surfaces thereof, in the barrier ribs 4 perpendicular to the display electrodes of the front substrate 3 or on the surfaces thereof. For example, by forming the discharge electric field increasing member M at the portion shown by the shaded portions M of FIG. 9(*c*) which is the cross-sectional view of the PDP of FIG. 9(*a*) cut along the line C—C and the shaded portion M of FIG. 9(*d*) which is the cross-sectional view of the PDP cut along the line D—D, the discharging electric field between the display electrodes X and Y can be increased. In this case, by using the front substrate 3 of FIG. 9(*e*) in place of the front substrate of FIG. 9(*b*) described above, a two-electrodes facing discharging type PDP can be formed as described above. Also, the whole barrier ribs may be the discharge electric field increasing member M. In addition, in FIGS. 9(*c*) and 9(*d*), the reference numeral 10*a* shows the barrier rib 2 parallel to the surface of the sheet of the back substrate side, 10*b* shows the barrier rib 2 perpendicular to the surface of the sheet of the back substrate side, and 11 shows the barrier rib 4 of the front substrate side.

The discharge electric field increasing member M can be attached to the surface of the element constituting the PDP by vapor-depositing the material thereof onto the surface or by applying a paste containing the material thereof on the surface followed by calcining. In another method other than the method described above, the discharge electric field increasing member M is previously dispersed in a material forming the element constituting the PDP and the element in which the discharge electric field increasing member M is dispersed may be formed. Furthermore, the element having dispersed therein the discharge electric field increasing member M can be formed by previously dispersing an organic compound giving the corresponding discharge electric field increasing member M in the element constituting the PDP and then decomposing the compound. In addition, it is preferred that when the discharge electric field increasing member M is formed on the surface of the element, the material may be formed into an island form or a layer form. In the case of the layer form, the thickness thereof is preferably 10 $\mu$m or less. When the discharge electric field increasing member M is incorporated in the element constituting the PDP, the material is preferably incorporated in an amount of from 5 to 40% by weight. Also, these methods may be used together. The impedance of the discharge electric field increasing member M between a pair of electrodes to be discharged must be higher than the impedance by discharging of the portion.

Then, according to the present invention, there is provided a second PDP comprising a front substrate 27 on which a pair of display electrodes are formed and a protective layer 29 is formed thereon and a back substrate 23, the substrates 23 and 27 facing each other, wherein a discharge electric field controlling material 5 is formed under the protective layer 29. In this case, the discharge electric field controlling material 5 has a function of controlling the electric field density, the electric field distribution, the electric field intensity, etc., in the discharging space by controlling the electric field from a pair of the electrodes, and capable of generating discharging at a lower voltage. The discharge electric field controlling material 5 can be particularly suitably used for the AC type surface discharge type PDP.

It is preferred that, for example, in the case of the front substrate of PDP, the discharge electric field controlling material 5 is disposed between a dielectric layer 24 and the protective layer 29. When the protective layer 29 also has a function of the dielectric layer 24, the discharge electric field controlling material 5 is preferably disposed between an insulator layer having both the functions and the display electrode. Also, the discharge electric field controlling material 5 may exist on the whole surface of the front substrate 27 (see, FIG. 10(*a*)), may exist only on a cell defined (demarcated) by a pair of display electrodes and the barrier ribs 21 (see, FIG. 10(*b*)), or may exist only on the display electrode (see, FIG. 5 10(*c*)). In the figures, the reference numeral 5 shows the discharge electric field controlling material. FIG. 10(*d*) shows the top view as shown from the front substrate side of the PDP shown in FIG. 10(*b*). As shown in the figure, the discharge electric field controlling material 5 is disposed in parallel with the stripe-form display electrodes and contributes to lowering the discharging voltage. In addition, in FIG. 10(*d*), for simplifying the explanation, the substrate 27, the dielectric layer 24 and the protective layer 29 are omitted. Furthermore, in addition to the case that the discharge electric field controlling material 5 is disposed in parallel with the display electrodes, the discharge electric field controlling material 5 may be placed as dot form per each cell.

Figure 11:
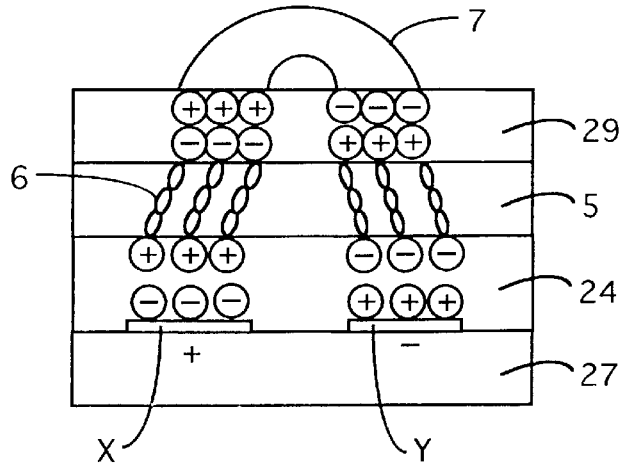
FIG. 11 is a view for illustrating a principle of reducing a discharging voltage in the PDP of the present invention provided with a discharge electric field increasing member.

Then, in the case of disposing the discharge electric field controlling material 5 between the dielectric layer 24 and the protective layer 29, the principle of lowering the discharging voltage is explained using FIG. 11. FIG. 11 shows the case of applying a predetermined voltage to a pair of display electrodes X and Y on a substrate 27. As shown in FIG. 11, the electrostatic charges formed on the display electrodes X and Y are transferred to a protective layer 29 via a dielectric layer 24. In this case, because dipoles 6 in a discharge electric field controlling material 5 move along the direction of the electric field, the distance between the electrostatic charges in the protective layer corresponding to the above described electrostatic charges can be shortened as compared with the distance between the electrostatic charges formed on the display electrodes X and Y As the result thereof, the electric field intensity on the protective layer 29 is increased (the interval of the line of electric force 7 is narrowed), whereby an electrical discharge can be caused even when the voltage is lowered.

The discharge electric field controlling material may be made of any material as long as the material has a function of causing electric discharge at a low voltage. It is preferred that the discharge electric field controlling material is made of a transparent conductive material. Practical examples of such a material include tin oxide, indium oxide and zinc oxide. In addition to the above-described materials, an electrically conductive material such as magnesium oxide containing a metal powder, a carbon powder, etc., can be used. It is preferred that the material and the composition of the discharge electric field controlling material are controlled so that the discharge electric field controlling material has a resistance in the range of from $10^4$ to $10^{10}$ $\Omega$·cm. When the resistance thereof is smaller than $10^4$ $\Omega$·cm, it becomes difficult to cause electric discharge, while when the resistance is larger than $10^{10}$ $\Omega$·cm, the effect of the invention of improving the discharging characteristics is reduced, which are not preferred. The resistance of the discharge electric field controlling material is more preferably in the range of from $10^6$ to $10^8$ $\Omega$·cm.

Furthermore, the discharge electric field controlling material can also be used as a dielectric layer by forming the discharge electric field controlling material at a thickness of from about 1 to 10 $\mu$m. In this case, to control the resistivity, the discharge electric field controlling material may contain a dielectric material such as magnesium oxide, aluminum oxide, etc. In addition, in the case of separately forming a dielectric layer, it is preferred that the thickness of the discharge electric field controlling material is from about 0.5 to 2 $\mu$m.

The discharge electric field controlling material can be attached by vapor deposition or by applying a paste containing the material followed by calcining as described above.

Furthermore, according to the present invention, there is further provided a PDP having the above-described discharge electric field increasing member and a discharge electric field controlling material, that is, a PDP wherein the discharge electric field controlling material is formed under a protective layer and the discharge electric field increasing member is formed to at least a part of elements constituting a plasma display panel existing between a display electrode and an address electrode. By having both the discharge electric field increasing member and the discharge electric field controlling material, the discharging voltage between the display electrode and the address electrode by the discharge electric field increasing member and the discharging voltage between the display electrodes by the discharge electric field controlling material explained above can be more lowered.

Figure 12:
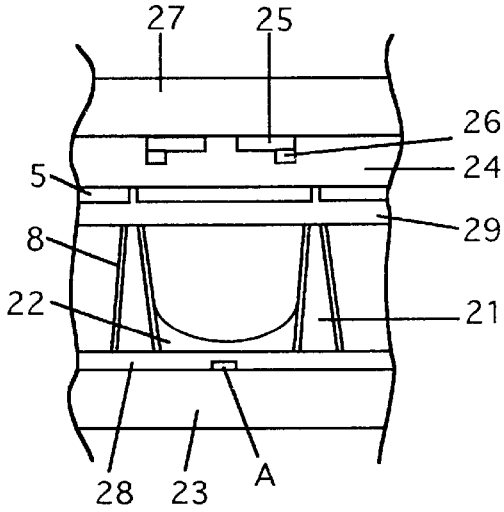
FIG. 12 is a schematic view illustrating the construction of the PDP according to the present invention.

FIG. 12 shows a schematic cross-sectional view of the PDP having both the materials described above. In the figure, the discharge electric field increasing members 8 are formed in an elongated discharging space formed along the address electrode direction between the belt-shaped barrier ribs 21 adjacent to each other, for example, on the sidewall surfaces of belt-shaped barrier ribs 21. The discharge electric field controlling materials 5 are formed in a stripe-form at the regions between the protective layer 29 and the dielectric layer 24 divided by the barrier ribs so that the material entirely covers a pair of the display electrodes (25 and 26). In addition, FIG. 12 is an embodiment of the invention, and any constructions which can give the effects of the invention can be employed.

Then, the examples of the invention are explained below but the invention is not limited to the following examples. (PDP including the discharge electric field increasing member)

EXAMPLES 1 TO 7 AND COMPARATIVE EXAMPLES 1 AND 2

Figure 13:
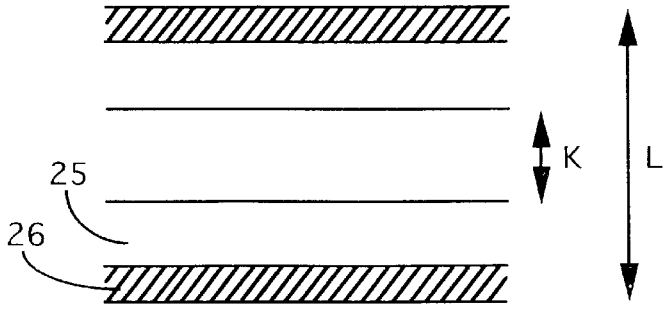
FIG. 13 is a view for illustrating definitions of discharging lengths of display electrodes in PDPs of Examples 1 to 5 of the present invention.

In Examples 1 to 5 and Comparative Example 1, a surface discharge type PDP was used and the fundamental construction thereof was the construction shown in FIG. 1. However, the shortest discharging length K and the longest discharging length L were changed as shown in Table 1. The shortest discharging length K and the longest discharging length L mean the lengths shown in FIG. 13.

In Examples 6 and 7 and Comparative Example 2, a two-electrodes facing discharging type PDP was used and the fundamental construction was the construction shown in FIG. 3. The shortest discharging length K and the longest discharging length L correspond to the heights of the barrier ribs.

In Example 4, 20% by weight of a discharge electric field increasing member (indium oxide) was added to a phosphor. In the other examples and comparative examples, 20% by weight of a discharge electric field increasing member (indium oxide) was added to the barrier ribs. Also, as the discharging gas, Example 5 used a 8% partial-pressure Xe—Ne gas (total pressure 500 Torr), and the other examples and comparative examples used a 5% partial-pressure Xe—Ne gas (total pressure 500 Torr). Furthermore, in all the examples and the comparative examples, a pixel pitch was 1.08 mm.

The discharging efficiencies and the discharge-initiation voltages in the examples and the comparative examples described above were measured. The results obtained are shown in Table 1. The discharging efficiencies are shown by relative efficiencies when that of Comparative Example 1 is defined to be 1.0.

TABLE 1

| | Shortest discharge length (μm) | Longest discharge length (μm9) | Bus electrode width (μm) | Transparent electrode width (μm) | Discharge form | Relative efficiency | Discharge initiation voltage (V) |
|---|---|---|---|---|---|---|---|
| E1 | 100 | 600 | 100 | 250 | plane | 1.2 | 200 |
| E2 | 150 | 600 | 100 | 225 | plane | 1.3 | 240 |
| E3 | 200 | 600 | 100 | 225 | plane | 1.5 | 240 |
| E4 | 150 | 600 | 100 | 200 | plane | 1.3 | 240 |
| E5 | 100 | 600 | 100 | 250 | plane | 1.2 | 240 |
| E6 | 140 | 140 | 100 | 140 | facing | 1.8 | 210 |
| E7 | 200 | 200 | 100 | 140 | facing | 2.3 | 230 |
| CE1 | 100 | 600 | 100 | 250 | plane | 1.0 | 240 |
| CE2 | 140 | 140 | 100 | 140 | facing | 1.5 | 230 |

E: Example
CE: Comparative Example

From Table 1, the following matters were found.

(1) From Example 1 and Comparative Example 1, it was found that the discharging initiation voltage could be lowered by 40 volts in the surface discharge type PDP by using the discharge electric field increasing member for the barrier ribs. Accordingly, the discharging electric current was lowered and the discharging efficiency could be improved by 20%.

(2) From Example 6 and Comparative Example 2, it was found that the discharging initiation voltage could be lowered by 20 volts in the electrodes facing discharging type PDP by using the discharge electric field increasing member for the barrier ribs, whereby the discharging electric current was lowered and the discharging efficiency could be improved by 30%.

(3) From Examples 2 and 3 and Comparative Example 1, it was found that the discharging efficiency could be improved by from 30 to 50% by using the discharge electric field increasing member for the barrier ribs when the discharging initiation voltage in each case was established to be the same in the surface discharge type PDP.

(4) From Example 7 and Comparative Example 2, it was found that the discharging efficiency could be improved by from 80% by using the discharge electric field increasing member for the barrier ribs when the discharging initiation voltage in each case was established to be the same in the electrodes facing discharging type PDP.

(5) From Example 5 and Comparative Example 1, it was found that when the partial pressure of Xe was increased from 5% to 8%, the discharging efficiency could be increased by 20% without increasing the discharging initiation voltage by using the discharge electric field increasing member for the barrier ribs.

(6) From Example 4 and Comparative Example 1, it was found that the discharging efficiency could be improved by adding the discharge electric field increasing member to the phosphor layer.

EXAMPLE 8

The surface discharge type PDP of the construction shown by FIG. 10(*a*) was made. In addition, as the discharge electric field controlling material, a film made of tin oxide having a thickness of 1.0 μm formed by a sputtering method was used.

When the discharge initiation voltage of the PDP obtained measured, the voltage was 140 volts. On the other hand, the discharge initiation voltage of a PDP without forming the discharge electric field controlling material was 240 volts as shown in Comparative Example 1 described above. Accordingly, by forming the discharge electric field controlling material, the discharge initiation voltage could be lowered by 100 volts.

EXAMPLE 9

The surface discharge type PDP of the construction shown in FIG. 10(*b*) was made. The PDP of FIG. 10(*b*) had the same construction as that of the PDP of FIG. 10(*a*) except that the discharge electric field controlling materials existed in each discharging space (cell) barrier ribed by the barrier ribs.

According to the PDP of FIG. 10(*b*), the cross talk to the adjacent cell could be reduced as compared with the PDP of FIG. 10(*a*).

As described above, according to the present invention, the discharging voltage between the display electrodes and between the display electrode and the address electrode can be lowered in a surface discharge type PDP and the discharging voltage between the display electrodes can be lowered in a two-electrodes facing discharging type PDP by forming the discharge electric field increasing member, without almost changing the discharging electric current. Also, because the discharging length can be prolonged and the partial pressure of Xe can be increased by the lowered rate of the discharging voltage, the discharging efficiency can be improved. Also, by lowering the voltage for driving circuits, the cost for the PDP can be lowered.

Furthermore, by forming the discharge electric field controlling material, the discharging voltage between the display electrodes can be lowered in the surface discharge type PDP.

What is claimed is:

1. A plasma display panel comprising a plurality of main electrodes for display, wherein a discharge electric field increasing member is provided in at least a part of elements constituting the plasma display panel existing between main electrodes which generate discharges, the elements comprising a dielectric layer covering the main electrodes, barrier ribs on the dielectric layer which define discharge cells therebetween and a phosphor layer formed on sidewalls of the barrier ribs and the dielectric layer between the barrier ribs, and the discharge electric field increasing member being provided as plural discrete members in respective display cells, and each of the plural discrete members being provided on only corresponding surface portions of the barrier ribs, within corresponding portions of the barrier ribs, and/or within corresponding portions of the phosphor layer.

2. The plasma display panel according to claim 1, wherein the discharge electric field increasing member comprises a metal, a carbon or a conductive metal oxide.

3. The plasma display panel according to claim 2, wherein the discharge electric field increasing member is formed by vapor deposition, or applying and calcining a paste containing a material thereof.

4. The plasma display panel according to claim 1, wherein the discharge electric field increasing member is provided as a layer on the surface of the barrier ribs.

5. A plasma display panel comprising a pair of substrates defining a discharge space, a plurality of display electrodes for surface discharge between adjacent electrodes formed on a first substrate of the pair of substrates and a laminate of a dielectric layer and a protective layer covering the display electrodes, wherein plural discrete discharge electric field controllers are formed in respective discharge cells, each thereof disposed in the dielectric layer at respective spaced positions, in the protective layer at respective spaced positions, or between respective, spaced and opposing positions of the dielectric layer and the protective layer, and the plural discrete discharge electric field controllers are not exposed to the discharge space and are not in contact with the display electrodes.

6. The plasma display panel according to claim 5, wherein the laminate comprises the dielectric layer covering the plurality of display electrodes and the protective layer covering the dielectric layer, and the plural discrete discharge electric field controllers are formed under the protective layer.

7. The plasma display panel according to claim 5, wherein the plural discrete discharge electric field controllers comprise a transparent conductive material, and the transparent conductive material is tin oxide, indium oxide or zinc oxide.

8. The plasma display panel according to claim 5, wherein the plural discrete discharge electric field controllers further include a dielectric material, and the dielectric material is magnesium oxide or aluminum oxide.

9. The plasma display panel according to claim 5, wherein the plural discrete discharge electric field controllers exist on a surface of a front substrate, only on a cell defined by a pair of display electrodes or only on the display electrodes.

10. The plasma display panel according to claim 5, wherein the plural discrete discharge electric field controllers have a resistance value in a range of $10^4$ to $10^{10}$ Ω·cm.

11. The plasma display panel according to claim 9, wherein the laminate comprises the dielectric layer and the protective layer, and the plural discrete discharge electric field controllers are provided as a layer under the protective layer.

12. A plasma display panel comprising a pair of substrates defining a discharge space, a plurality of display electrodes for surface discharge between adjacent electrodes formed on a first substrate of the pair of substrates, a laminate of a dielectric layer and a protective layer formed thereon, a plurality of address electrodes crossing the display electrodes formed on a second substrate of the pair of substrates and belt-shaped barrier ribs formed between the address electrodes, the dielectric layer covering the display electrodes, barrier ribs on the dielectric layer which define discharge cells therebetween and a phosphor layer formed on sidewalls of the barrier ribs and the dielectric layer between the barrier ribs, wherein plural discrete discharge electric field controllers are formed in respective discharge cells, each thereof disposed in the dielectric layer at respective spaced positions, in the protective layer at respective spaced positions, or between respective, spaced and opposing positions of the dielectric layer and the protective layer, the plural discrete discharge electric field controllers are not exposed to the discharge space and are not in contact with the display electrodes, and a discharge electric field increasing member is formed within the phosphor layer in an elongated discharge space formed between adjacent barrier ribs along a direction of the address electrodes.

13. The plasma display panel according to claim 1, wherein the discharge electric field increasing member is provided to lower a discharge initiation voltage between at least one pair of the main electrodes.

14. The plasma display panel according to claim 1, wherein the discharge electric field increasing member is provided with a predetermined shape to lower discharge initiation voltages between selected pairs of the main electrodes.

* * * * *